US006881042B2

(12) United States Patent
Heo et al.

(10) Patent No.: US 6,881,042 B2
(45) Date of Patent: Apr. 19, 2005

(54) RECIPROCATING COMPRESSOR HAVING REDUCED VIBRATION

(75) Inventors: Jong-Tae Heo, Changwon (KR); Seong-Yeol Hyeon, Changwon (KR); Kyung-Bum Hur, Seoul (KR); Gyoo-Jong Bae, Changwon (KR); Jang-Whan Kim, Changwon (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/312,694

(22) PCT Filed: May 25, 2001

(86) PCT No.: PCT/KR01/00877

§ 371 (c)(1),
(2), (4) Date: Dec. 30, 2002

(87) PCT Pub. No.: WO02/095232

PCT Pub. Date: Nov. 28, 2002

(65) Prior Publication Data

US 2003/0175135 A1 Sep. 18, 2003

(51) Int. Cl.[7] ..... F04B 17/04; F04B 17/00

(52) U.S. Cl. ..... 417/417; 417/416; 417/415; 417/363

(58) Field of Search ..... 417/363, 415, 417/416, 417

(56) References Cited

U.S. PATENT DOCUMENTS 4,836,757 A * 6/1989 Curwen et al. ..... 417/416
5,645,407 A * 7/1997 Kralick et al. ..... 417/383
5,664,959 A * 9/1997 Duell et al. ..... 439/278
5,993,175 A * 11/1999 Kim et al. ..... 417/417
6,089,836 A * 7/2000 Seo ..... 417/417
6,174,141 B1 1/2001 Song
6,202,791 B1 * 3/2001 Oh et al. ..... 184/6.16

FOREIGN PATENT DOCUMENTS

DE 198 18 950 A1 * 11/1998 ..... H02K/1/34
EP 0745773 A1 12/1996
JP 07-109975 A 4/1995
JP 11-22642 A 1/1999

* cited by examiner

*Primary Examiner*—Cheryl J. Tyler
*Assistant Examiner*—Timothy P. Solak
(74) *Attorney, Agent, or Firm*—Birch, Stewart, Kolasch & Birch, LLP

(57) ABSTRACT

A reciprocating compressor includes: a reciprocating motor, an outer stator and an inner stator provided with at least one step portion at both sides thereof, and an armature linearly moving therebetween; a compression unit having a cylinder and a piston inserted in the cylinder to receive a linear and reciprocal driving force of the reciprocating motor and compress a gas; a suction unit sucking a gas into the compression unit; a discharge unit discharging the gas compressed in the compression unit to outside the container; a resonance spring unit elastically supporting the piston and the armature; and a frame unit supporting the compression unit and the reciprocating motor. Because stable driving is achieved in its operation, generation of vibration and noise can be minimized, heightening reliability. In addition, the amount of gas discharge can be accurately controlled.

39 Claims, 11 Drawing Sheets

RECIPROCATING COMPRESSOR HAVING REDUCED VIBRATION

This application is the national phase under 35 U.S.C. § 371 of PCT International Application No. PCT/KR01/00877 which has an International filing date of May 25, 2001, which designated the United States of America.

TECHNICAL FIELD

The present invention relates to a reciprocating compressor that is capable of minimizing a vibration noise occurring in operation, accurately controlling the amount of a compressed gas to be discharged, simplifying assembly of a construction components, and minimizing the assembly tolerance.

BACKGROUND ART

In general, a compressor is an instrument to compress a gas such as a coolant. There are several types of compressors including a rotary compressor, a reciprocating compressor, a scroll compressor.

The general compressor includes a closed container having a space therein, an electronic mechanism unit installed inside the closed container and generating a driving force, and a compression mechanism unit for receiving the driving force from the electronic mechanism unit and compressing gas.

FIG. 1 is a sectional view of the rotary compressor in accordance with a conventional art.

As shown in FIG. 1, in the rotary compressor, as a rotor 2 of an electronic mechanism unit (M) installed in a closed container 1 is rotated, a rotational shaft 3 press-fit in the rotor 2 is rotated. According to the rotation of the rotational shaft 3, a rolling piston 5 inserted in an eccentric part 3*a* of the rotational shaft 3 positioned in the compression space (P) of a cylinder 4 linearly contacts the inner circumferential surface of the compression space (P) of the cylinder and also linearly contacts a vane (not shown) inserted at one side of the cylinder 4 to divide the compression space (P) into a high pressure portion and a low pressure portion, so as to be rotated in the cylinder compression space (P) to compress a coolant gas sucked into a suction hole 4*a* formed at the cylinder 4 and discharge it through a discharge passage 4*b*. These processes are repeatedly performed.

FIG. 2 is a sectional view of a reciprocating compressor in accordance with a conventional art.

As shown in FIG. 2, in the reciprocating compressor, as a rotor 12 of an electronic mechanism unit (M) mounted in a closed container 11 is rotated, a crank shaft 13 press-fit to the rotor 12 is rotated. According to the rotation of the crank shaft 13, a piston 14 coupled to an eccentric part 13*a* of the crank shaft 13 makes a linear and reciprocal movement in the compression space (P) of the cylinder 15, to compress a coolant gas sucked through a valve assembly 16 coupled to the cylinder 15 and discharge the coolant gas through the valve assembly 16. These processes are repeatedly performed.

FIG. 3 is a sectional view of a scroll compressor in accordance with a conventional art.

As shown in FIG. 3, in the scroll compressor, as a rotor 22 of the electronic mechanism unit (M) mounted in the closed container 21 is rotated, a rotational shaft 23 having an eccentric part 23*a* press-fit to the rotor 22 is rotated. According to the rotation of the rotational shaft 23, an orbital scroll 24 connected to the eccentric part 23*a* of the rotational shaft 23 is engaged with a fixed scroll 25 and revolved. Then, a plurality of compression pockets formed by wraps 24*a* and 25*a* having an involute curved line form respectively formed at the orbital scroll 24 and the fixed scroll 25 are reduced in size, to suck, compress and discharge a coolant gas continuously. This processes are repeatedly performed.

The structural and reliability aspects of the rotary compressor, the reciprocating compressor and the scroll compressor of the conventional art each operated in a compression mechanism as described above will now be described.

First, referring to the rotary compressor, in the structural aspect, since a plurality of balance weights 6 are used coupled to the rotor 2 to rotational balance between the rotational shaft 3 having the eccentric part 3*a*, the rolling piston 5 press-fit to the eccentric part 3*a* and the eccentric part 3*a*, there are many constructional components and its structure is somewhat complicated. In the aspect of a reliability, since the eccentric part 3*a* and the rolling piston 5 formed at the rotational shaft 3 are eccentrically rotated, a big vibration noise is generated.

Referring to the reciprocating compressor, in its structural aspect, the balance weight 13*b* is used for a rotational balance between the crank shaft 13 having an eccentric part 13*a*, the piston 14 coupled to the crank shaft 13 and the crank shaft eccentric part 13*a*, resulting in that there are numerous components and its structure is complicated.

In addition, in the aspect of a reliability, since the eccentric part 13*a* formed at the crank shaft 13 is eccentrically rotated, a vibration noise is generated, and since the valve assembly 16 is operated in sucking and discharging, the noise in sucking and discharging is made big.

Referring to the scroll compressor, in the aspect of its structural aspect, the balance weight 26 is used for a rotational balance between the rotational shaft 23 having the eccentric part 23*a*, the orbital scroll 24 having a wrap formed in an involute curve form, the fixed scroll 25 and the eccentric part 23*a*, resulting in that there are many components and its structure is complicated. In addition, it is difficult to process the orbital scroll 24 and the fixed scroll 25.

In addition, in the aspect of reliability, a vibration noise is generated due to the turning movement of the orbital scroll 24 and the eccentric movement in the eccentric part 23*a* of the rotational shaft.

As stated above, in case of the rotary compressor, the reciprocating compressor and the scroll compressor, the compression mechanism unit compresses a gas upon receipt of a rotational force of the electronic mechanism unit. Thus, in order to control the amount of the compressed gas generated in the compressor, the number of rotations of the electronic mechanism unit should be reduced or the electronic mechanism unit should stop rotating, which makes it difficult to accurately control the amount of the compressed gas.

In addition, since the eccentric parts 3*a*, 13*a* and 23*a* are provided at the shaft which is rotated upon receipt of the rotational force from the electronic mechanism unit, the balance weights 6, 13*b* and 26 are used, causing that a driving force is much consumed, and as the vibration noise is generated in operation, its reliability is degraded. In addition, since the structure is relatively complicate, the assembly productivity is degraded.

DISCLOSURE OF THE INVENTION

Therefore, it is an object of the present invention to provide a reciprocating compressor that is capable of accurately controlling the amount of a compressed gas to be discharged as well as minimizing a vibration noise generated in operation.

Another object of the present invention is to provide a reciprocating compressor that is capable of simplifying assembly of components and minimizing an assembly tolerance.

To achieve these objects, there is provided a reciprocating compressor including: a container communicating with a gas suction pipe for sucking a gas; a reciprocating motor installed in the container and having an outer stator and an inner stator provided with at least one step portion at both sides thereof, and an armature linearly moving therebetween; a compression unit having a cylinder and a piston inserted in the cylinder to receive a linear and reciprocal driving force of the reciprocating motor and compress a gas while making a linear and reciprocal movement; a suction unit sucking a gas sucked into the container through the gas suction pipe due to a pressure difference in the compression unit, into the compression unit; a discharge unit discharging the gas compressed in the compression unit to outside the container; a resonance spring unit elastically supporting the piston and the armature; and a frame unit supporting the compression unit and the reciprocating motor and having a front frame which supports the reciprocating motor at the front side and a rear frame which supports the reciprocating motor at the rear side, one of the front and the rear frame having at least two step portions for supporting both outer stator and inner stator of the reciprocating motor, the front frame and the rear frame having at least one step portion of which circumferential face forms a concentric circle with the inner diameter of the cylinder.

MODES FOR CARRYING OUT THE PREFERRED EMBODIMENTS

The reciprocating compressor of the present invention will now be described with reference to the accompanying drawings.

Figure 1:
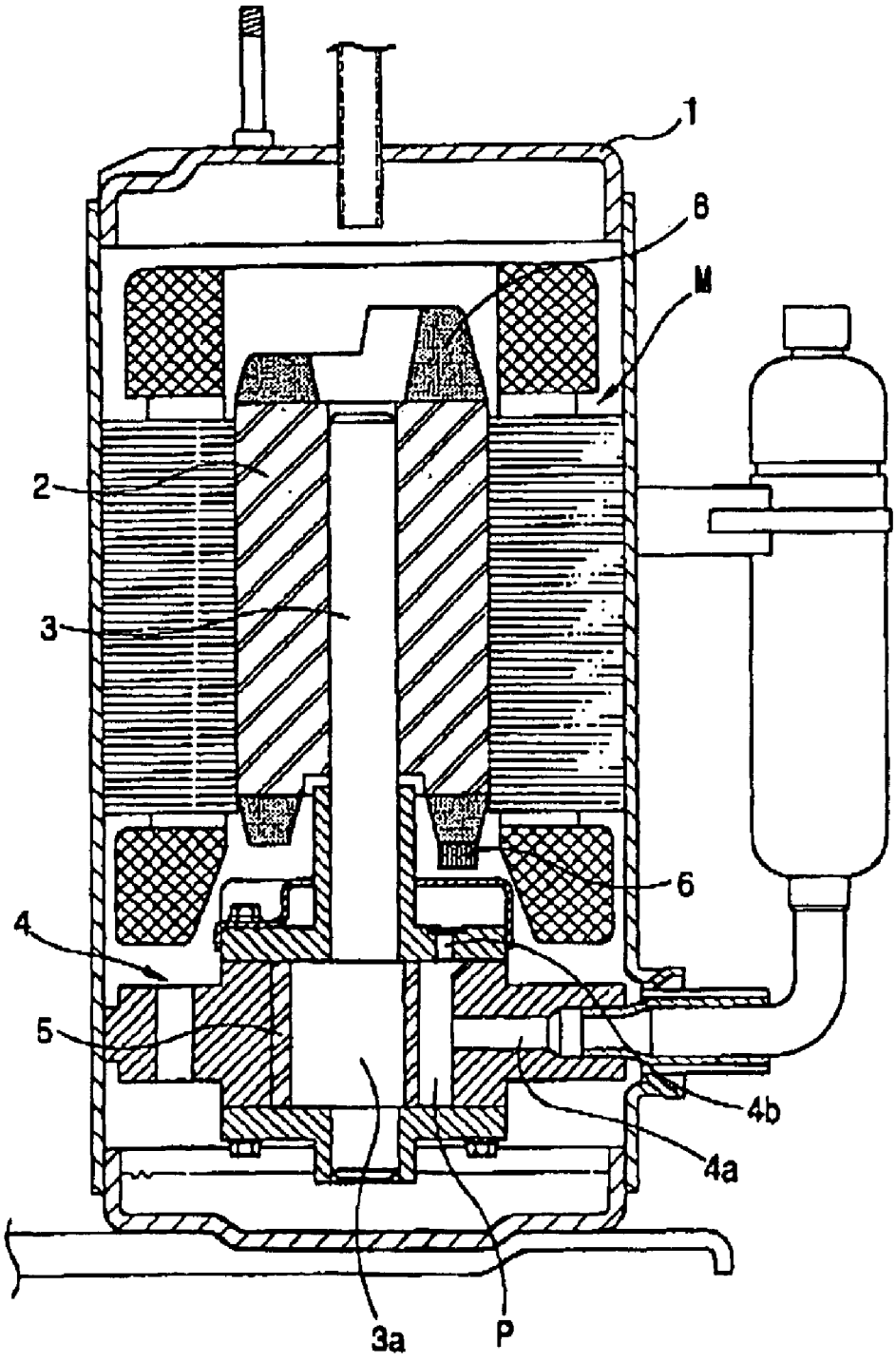
FIG.1 CONVENTIONAL ART
FIG. 1 is a sectional view showing a rotary compressor in accordance with a conventional art.
Figure 2:
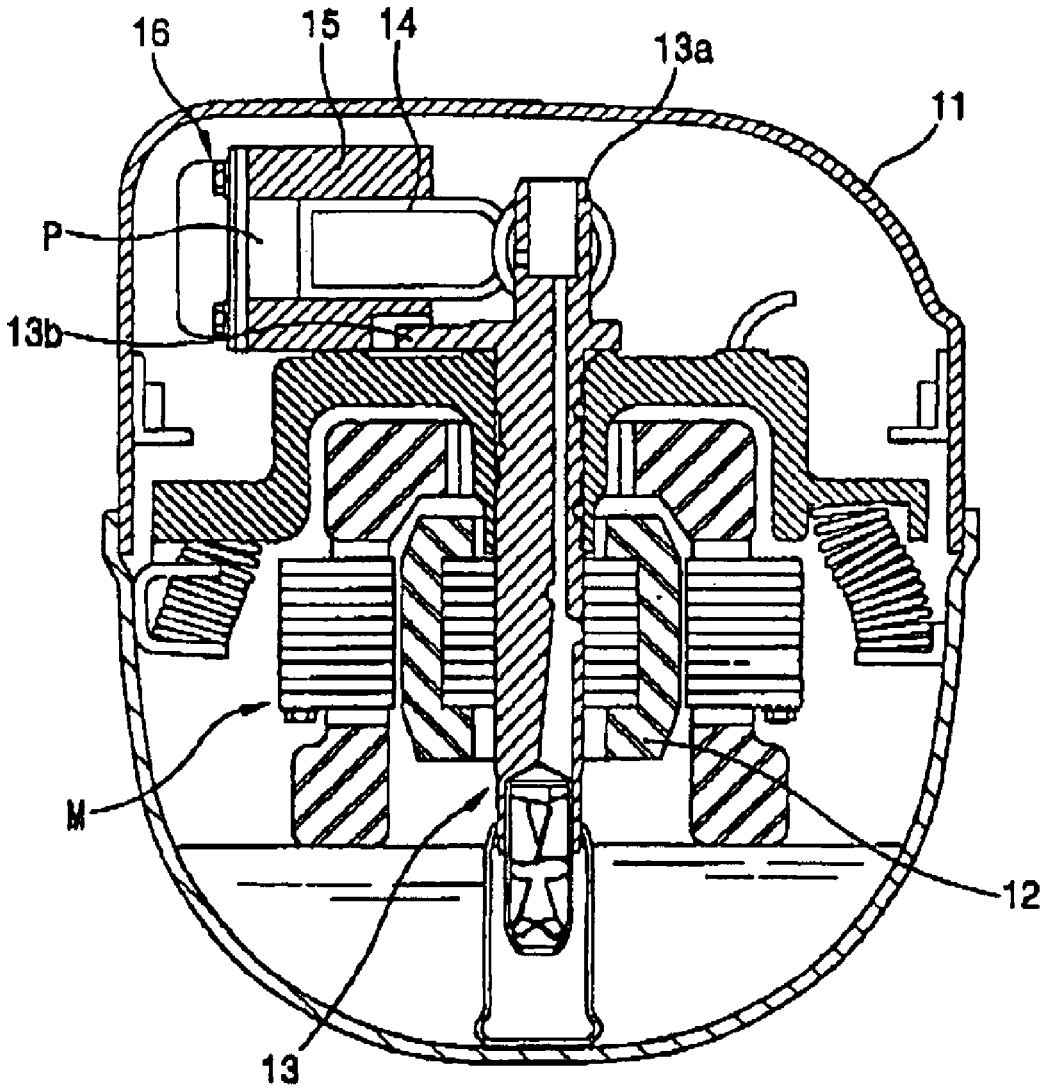
FIG. 2 CONVENTIONAL ART
FIG. 2 is a sectional view showing a reciprocating compressor in accordance with a conventional art.
Figure 3:
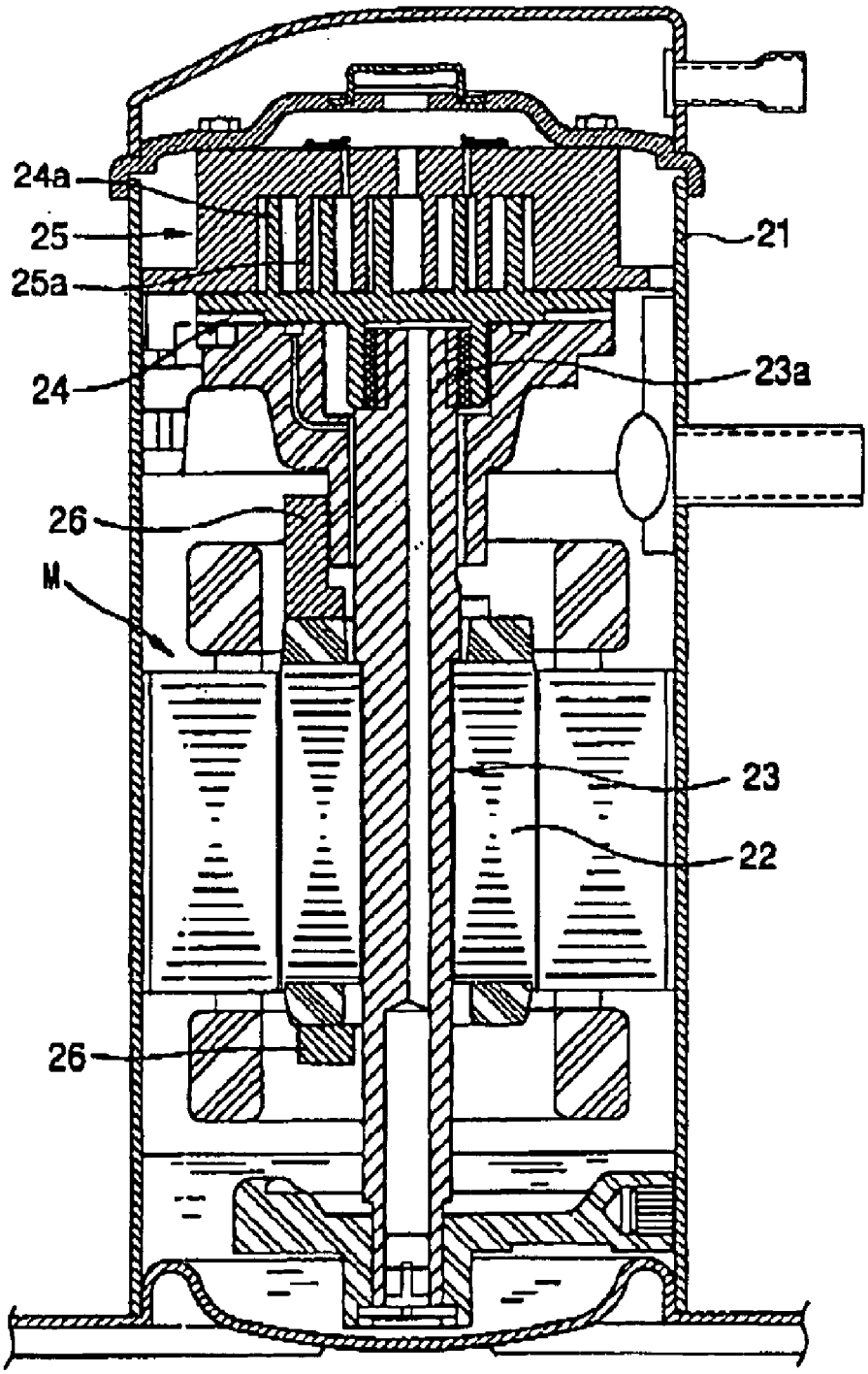
FIG.3 CONVENTIONAL ART
FIG. 3 is a sectional view showing a scroll compressor in accordance with a conventional art.
Figure 4:
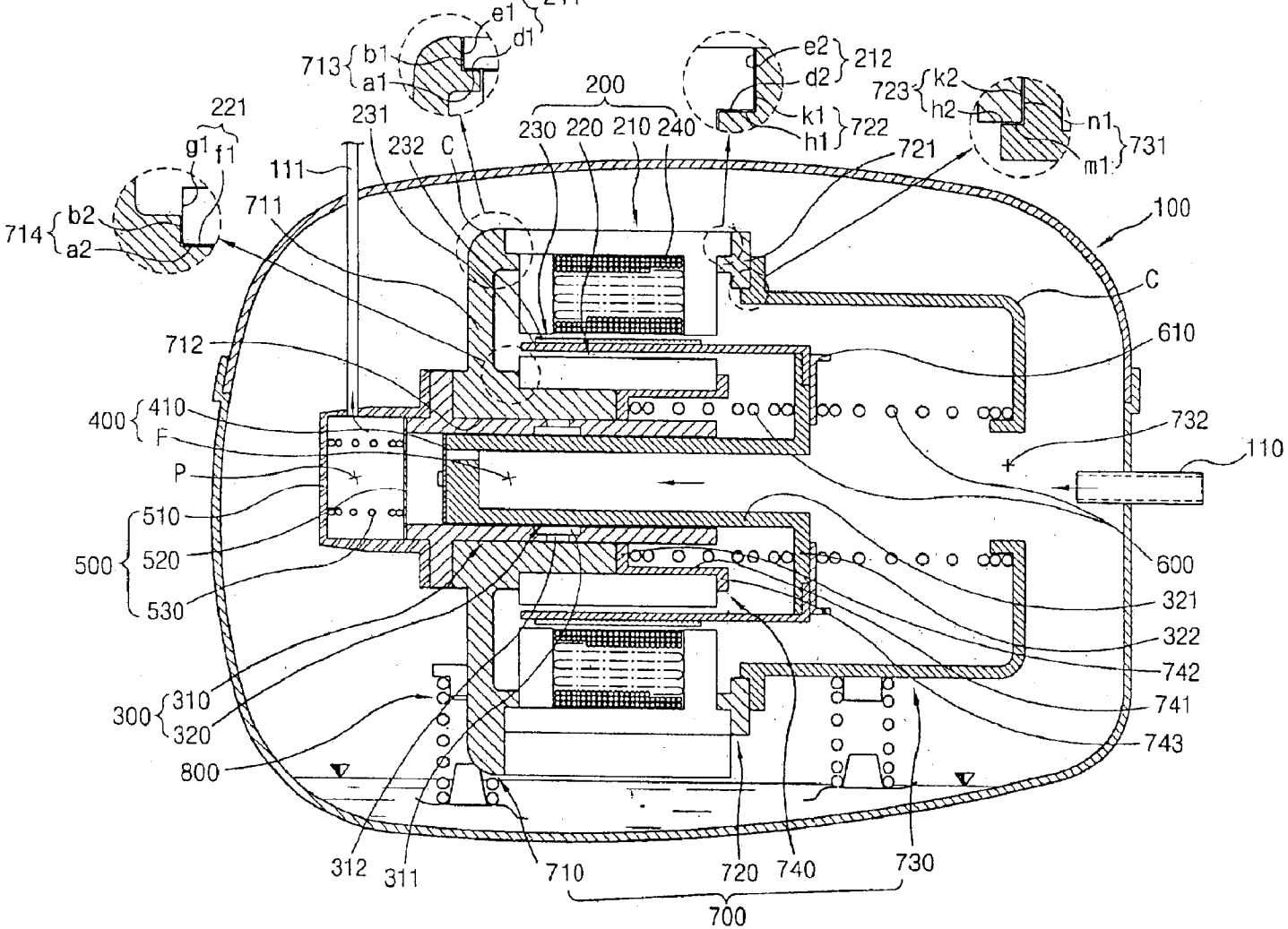
FIG. 4 is a sectional view showing a reciprocating compressor in accordance with a first embodiment of the present invention.

FIG. 4 is a sectional view showing a reciprocating compressor in accordance with a first embodiment of the present invention.

As shown in FIG. 4, the reciprocating compressor includes a container 100 communicating with a gas suction pipe 110 for sucking a gas, a reciprocating motor 200 installed in the container 100, for generating a linear reciprocal driving force; a compression unit 300 positioned inside the reciprocating motor 200, for receiving the linear reciprocal driving force of the reciprocating motor 200 and compressing a gas; a suction unit 400 positioned at one side of the compression unit 300, for rendering the gas sucked into the container 100 through the gas suction pipe 110 due to the pressure difference in the compression unit 300 to be sucked into the compression unit 300; a discharge unit 500 positioned at the other side of the compression unit 300, for discharging the gas compressed in the compression unit 300 to the outside of the container 100; a resonance spring unit 600 constructing the compression unit 300, for elastically supporting the piston which makes a reciprocal movement linearly upon receipt of the linear reciprocal driving force of the reciprocating motor 200; a frame unit 700 at which the reciprocating motor 200 and the compression unit 300 are mounted; and a support spring 800 elastically supporting the frame unit 700 at the container 100.

The frame unit 700 includes a front frame 710, a middle support member 720 and a rear frame 730. The front frame 710 includes a cylinder insertion hole 712 formed at the middle of body part 711 of a predetermined form, a first step portion 713 formed at a marginal portion of one side of the body part 711 and a second step portion 714 formed at the middle portion of one side of the body part 711.

The first step portion 713 and the second step portion 714 of the front frame have a circumferential faces a1 and a2 having a predetermined width and a vertical faces b1 and b2 (in the drawing) formed vertical to the circumferential faces a1 and a2. The circumferential face a1 of the first step portion 713 and the circumferential face a2 of the second step portion 714 are formed to make a concentric circle.

The reciprocating motor 200 includes an outer stator 210, an inner stator 220 and an armature 230.

The outer stator 210 is provided to be cylindrical form in which a winding coil 240 is combined, and step portions 211 and 212 are formed at both sides thereof.

The step portion 211 of the outer stator 210 is insertedly combined into the first step portion 713 of the front frame.

At this time, a circumferential face d1 and a vertical face e1 (in the drawing) forming the step portion 211 of the outer stator and the circumferential face a1 and the vertical face b1 forming the first step portion 713 of the front frame supportedly contact each other.

The inner stator 220 has a cylindrical form with a predetermined thickness, of which a step portion 221 forming an inner corner is insertedly combined into the second step portion 714 of the front frame At this time, the inner stator 220 is positioned with a predetermined interval at the inner side of the outer stator 210, and a circumferential face f1 and a vertical face g1 (in the drawing) forming the step portion 221 of the inner stator and the circumferential face a2 and the vertical face b2 forming the second step portion 714 of the front frame supportedly contact each other.

The armature 230 includes a magnet holder 231 having a cylindrical form and a permanent magnet 232 coupled to the outer circumferential surface of the magnet holder 231. The armature 230 is inserted between the outer stator 210 and the inner stator 220.

The compression unit 300 includes a cylinder 310 and a piston 320.

The cylinder 310 is inserted into the cylinder insertion hole 712 of the front frame 710 and positioned inside the inner stator 220 of the reciprocating motor 200.

At this time, the inner diameter of the cylinder 310 and the circumferential faces a1 and a2 of the first and the second step portions 713 and 714 make the concentric circle.

The piston 320 includes a flange 322 extended and bent to have a predetermined area at one side of the body part 321 having a annular bar form with a predetermined length in which a gas flowing passage (F) is formed in the longitudinal direction.

The body part 321 of the piston 320 is inserted into the cylinder 310 and the flange 322 is coupled to the armature 230.

An annular groove 311 having a predetermined width and depth is formed on the inner wall of the cylinder 310 of the compression unit 300. The distance between the groove 311 and the front end (left side in Figure) of the cylinder 310 is longer than the distance between the groove 311 and the rear end of the cylinder 310.

The groove 311 of the cylinder is preferably formed to be positioned roughly at the middle portion of the overall length of the piston 320 when the piston 320 comes to the bottom dead point.

At least one lubricant through hole 312 is provided within the groove 311 of the cylinder, having the smaller inner diameter than the width of the groove 311.

It is preferred that the lubricant through hole 312 is formed both at the upper and the lower portions, so as to be positioned in the vertical line on the basis of the lubricant face.

The middle support member 720 of the frame unit 700 includes a first step portion 722 formed at one side of the annular body 721 having a predetermined thickness and width and a second step portion 723 formed at the other side thereof.

A circumferential face h1 forming the first step portion 722 and a circumferential face h2 forming the second step portion 723 make the concentric circle, and the outer circumferential face of the annular body 721 and the circumferential face h1 forming the first step portion 722 make the concentric circle. The inner diameter of the annular body 721 is larger than the inner diameter of the outer stator of the reciprocating motor 200.

The middle support member 720 is insertedly coupled to the step portion 212 of the outer stator of the reciprocating motor 200. At this time, the circumferential face h1 and the vertical face k1 (in the drawing) forming the first step portion 722 of the middle support member and a circumferential face d2 and a vertical face e2 forming the step portion 212 of the outer stator supportedly contact each other.

The rear frame of the frame unit 700, formed in a cap form, includes a step portion 731 formed at one side and a through hole 732 formed at the other side thereof.

The rear frame 730 is insertedly coupled to the second step portion 723 of the middle support member. At this time, a circumferential face m1 and a vertical face (in the drawing) forming the step portion 731 of the rear frame and a circumferential face h2 and a vertical face k2 forming the second step portion 723 supportedly contact each other, and the through hole 732 of the rear frame is positioned adjacent to the gas suction pipe 110.

The frame unit 700 includes an inner support member 740 which has a cylindrical body 741 having a predetermined diameter and length, a support 742 bent extended to have a predetermined area at one side of the cylindrical body 741 and a stopper 743 bent extended to have a predetermined area at the other side thereof.

The support 742 and the cylindrical body 741 of the inner support member 740 are inserted between the outer circumferential surface of the cylinder 310 and the inner circumferential surface of the inner stator 220, so as to be integrally combined with the inner stator 220 by welding or bolting.

At this time, the support 742 supportedly contacts the front end of the front frame 710 and the stopper 743 is supported by one side face of the inner stator 220.

The cylindrical body 741 of the inner support member and the circumferential faces h1 and h2 of the first and the second step portions 722 and 723 of the middle support member make concentric circle.

The resonance spring unit 600 includes two coil springs, one of which is coupled between the support 742 of the inner support member and the flange 322 of the piston and the other is coupled between the flange 322 of the piston and the inner side face of the rear frame 730.

A spring base 610 of a predetermined form is inserted between components which contact the coil spring.

The piston 320 which makes a reciprocal movement linearly upon receipt of the driving force of the reciprocating motor 200 and the combining part to which the armature 230 of the reciprocating motor 200 is combined is preferably formed in a manner that the flange 322 of the piston, the plastic armature 230, that is, the magnet holder 231 made of plastic, and the spring base 610 supporting the resonance spring unit 600 are sequentially arranged to be engaged.

That is, as they are engaged in the order of metal-plastic-metal, the armature made of plastic is prevented from deforming or damaging, helping maintain the rigidity of the engaging structure.

Figure 5:
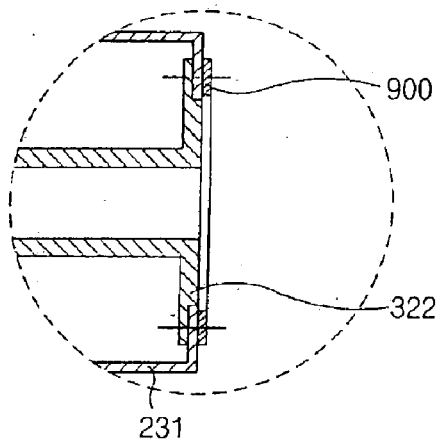
FIG. 5 is a partial sectional view showing a mass member of the reciprocating compressor in accordance with the first embodiment of the present invention.

FIG. 5 is a partial sectional view showing a mass member of the reciprocating compressor in accordance with the first embodiment of the present invention.

As shown in FIG. 5, a mass member 900 is provided between the magnet holder 231 constructing the armature 230 of the reciprocating motor and the flange 322 of the piston 320 to which the magnet holder 231 is combined. The mass member 900 preferably has a disk form having a predetermined thickness.

Thanks to the attachment of the mass member 900, the resonance frequency of the moving mass constructed by including the piston 320 which makes a reciprocal movement linearly together with the armature 230 of the reciprocating motor 200 upon receipt of the linear reciprocal movement of the armature 230 and the resonance spring unit 600 supporting the piston 320 can be accurately controlled.

Accordingly, since the resonance frequency of the moving part of the reciprocating motor 200 can be roughly conformed to the frequency of the power source supplied to the reciprocating motor 200, the stroke of the reciprocating motor can be more accurately controlled.

The suction unit 400 includes a gas flowing passage (F) formed inside the body part 321 of the piston 320 and a suction valve 410 coupled to the front end of the piston 320, for opening and closing the gas flowing passage (F) according to the pressure difference.

The discharge unit 500 includes a discharge cover 510 combined to cover the cylinder 310, that is, the compression space (P), a discharge valve 520 positioned inside the discharge cover 510, for opening and closing the compression space (P) of the cylinder 310, and a valve spring 530 for elastically supporting the discharge valve 520.

The front frame 710 and the middle support member 720 supporting the both sides of the reciprocating motor 200 is engaged by a plurality of engaging bolts and nuts each having a predetermined length.

Figure 6:
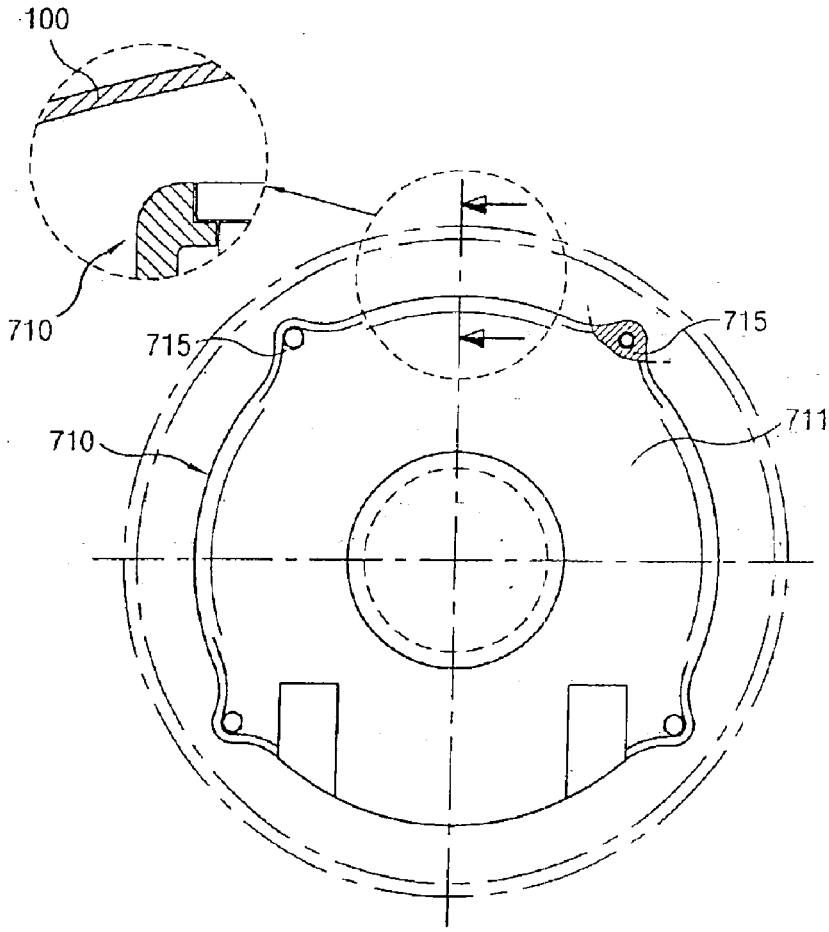
FIG. 6 is a schematic view showing a bolt engaging part of the reciprocating compressor in accordance with the first embodiment of the present invention.

FIG. 6 is a schematic view showing a bolt engaging part of the reciprocating compressor in accordance with the first embodiment of the present invention.

As shown in FIG. 6, the bolt engaging portion 715 is extendedly protruded in a semi-circle form at the marginal portion of the body part 711 of the front frame, in which a screw hole is formed.

The bolt engaging portions 715 are disposed at the upper and the lower sides on the basis of a horizontal line when the front frame 710 is vertically positioned, and the bolt engaging portions 715 are positioned at the left and the right sides on the basis of the central vertical line of the front frame 710.

The bolt engaging portions of the middle support member 720, which is engaged along with the front frame 710 are disposed in the same form.

A fillet portion (C) is formed at the corner portions of the front frame 710, the rear frame 730 and the middle support member 720 constructing the frame unit 700.

The fillet portion (C) includes a relatively large portion and a relatively small portion to reduce the outer size of the compressor.

The fillet (C) may be modified to a flat form chamfer.

Since the front frame 710 constructing the frame unit 700 and the bolt engaging portion 715 engaging the middle support member 720 are positioned between the vertical line and the horizontal line rather than being positioned on the central vertical line and the horizontal line of the front frame 710 and the middle support member 720, and the fillet (C) is provided at the corner of the frame unit 700, the frame unit 700 is prevented from contacting the inner face of the container 100 and the distance to the inner face is minimized. Thus, its structure is compact.

The support spring 800 includes a plurality of coil springs. One side of the support spring 800 is fixedly supported at the bottom of the container 100 and the other side thereof is fixedly supported by the frame unit 700.

Figure 7:
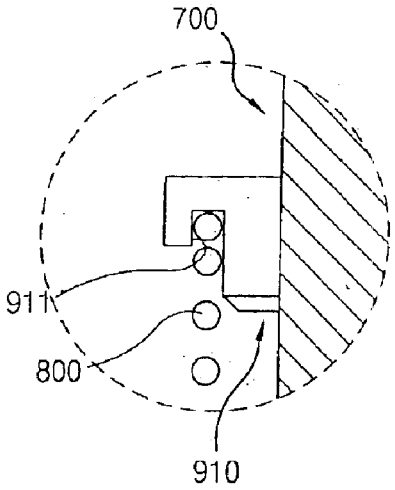
FIG. 7 is a schematic view showing a support spring and a combining protrusion in accordance with the first embodiment of the present invention.

FIG. 7 is a schematic view showing a support spring and a combining protrusion in accordance with the first embodiment of the present invention.

As shown in FIG. 7, in the structure in which the support spring 800 and the frame unit 700 are fixedly supported, a combining protrusion 910 is provided to be integrally formed at one side of the frame unit 700.

A combing recess 911 is formed with a predetermined depth at a contact line where the outer circumference of the combining protrusion 910 and the frame unit 700 meet.

The combining protrusion 910 is inserted to be fixedly combined into one side of the support spring 800.

Figure 8:
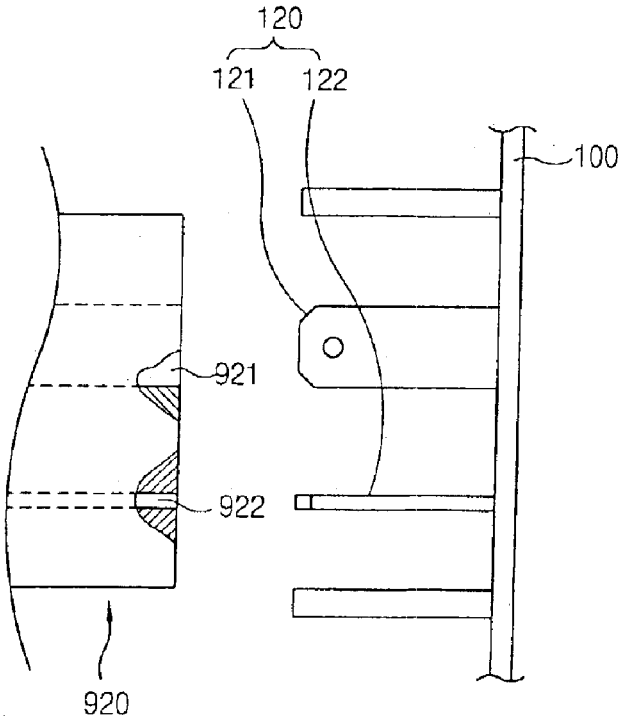
FIG. 8 is a schematic view showing a power supply terminal and a fixing terminal of a first connector and a second connector in accordance with the first embodiment of the present invention.
Figure 9:
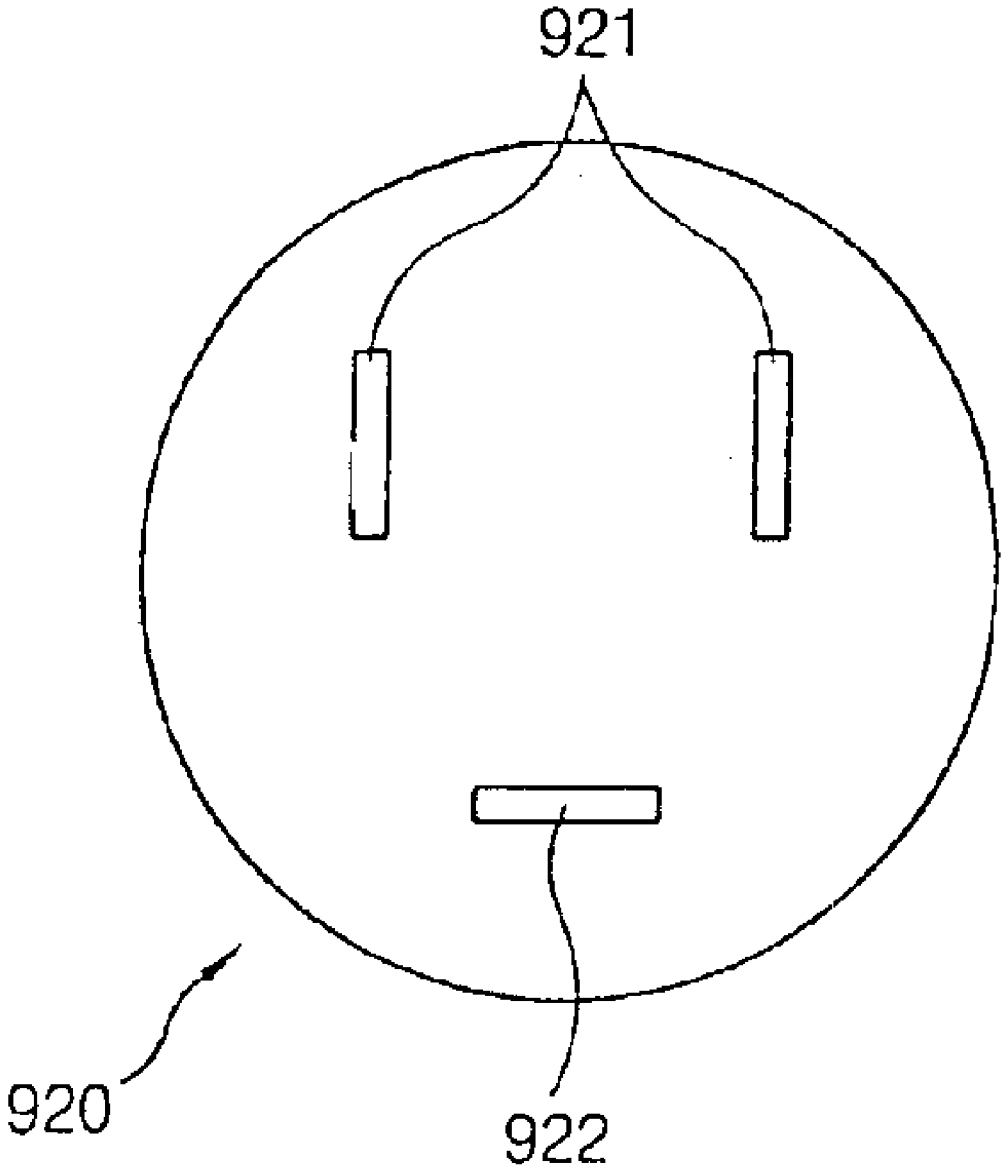
FIG. 9 is a front view showing the second connector in accordance with the first embodiment of the present invention.

FIG. 8 is a schematic view showing a power supply terminal and a fixing terminal of a first connector and a second connector in accordance with the first embodiment of the present invention, and FIG. 9 is a front view showing the second connector in accordance with the first embodiment of the present invention.

As shown in FIGS. 8 and 9, a first connector 120 having two power supply terminals 121 to which an external power is supplied and at least one fixing terminal 122 is formed penetrating the container 100.

A second connector 920 is provided having two power supply terminal 921 connected to the power supply terminal 121 of the first connector 120 and withdrawn from the reciprocating motor 200 to supply a power to the reciprocating motor 200 and a fixing terminal 922 insertedly combined with the fixing terminal 122 of the first connector.

When the first connector 120 and the second connector 920 are combined with each other, the power supply terminal 121 of the first connector 120 and the power supply terminal 921 of the second connector 920 are combined, and at the same time, the fixing terminal 122 of the first connector 120 and the fixing terminal 922 of the second connector 920 are insertedly combined with each other.

As the power supply terminal 121 of the first connector and the power supply terminal 921 of the second connector 920 are connected to each other, an external power is supplied to the reciprocating motor 200, and as the fixing terminal 122 of the first connector 120 and the fixing terminal 922 of the second connector 920 are combined to each other, the first and the second connectors 120 and 920 are firmly combined and maintained.

The operational effect of the reciprocating compressor constructed as described above will now be explained.

When a power is supplied to the reciprocating motor 200, a current flows to the winding coil 240 which constructs the reciprocating motor 200, and accordingly, a flux is generated at the outer stator 210 and the inner stator 220. The interaction of the flux generated at the outer stator 210 and the inner stator 220 and the flux according to the permanent magnet 232 of the armature 230 renders the armature 230 to undergo a linear reciprocating movement.

The linear and reciprocal driving force of the armature 230 is transmitted to the piston 320, and then, the piston 320 is linearly and reciprocally moved in the compression space (P) of the cylinder.

At this time, the resonance spring unit 600 stores the linear and reciprocal movement force of the reciprocating motor 200 as an elastic energy and discharges it and induces a resonance movement.

Due to the pressure difference caused when the piston 320 is linearly and reciprocally moved in the compression space (P) of the cylinder 310, the gas sucked into the gas suction pipe 110 is sucked into the compression space (P) of the cylinder of the compression unit 300 through the suction unit 400, compressed therein and discharged through the discharge unit 500.

The high temperature and high pressure gas discharged through the discharge unit 500 is discharged through the discharge pipe 111 to outside the container 100.

In the reciprocating compressor of the first embodiment of the present invention, since the piston 320 is linearly and reciprocally moved in the cylinder 310 upon receipt of the linear and reciprocal driving force of the reciprocating motor 200, to compress the gas, its driving is stably made.

In addition, since the stroke of the piston 320 can be controlled by controlling the linear movement distance of the reciprocating motor 200, the amount of the compressed gas to be discharged can be accurately controlled.

The step portion 211 of the outer stator 210 which constructs the reciprocating motor 200 supportedly contacts to be combined with the first step portion 713 of the front frame 710 which constructs the frame unit 700, and the step portion 221 of the inner stator 220 of the reciprocating motor supportedly contacts to be combined with the second step portion 714 of the front frame 710, so that the concentricity of the outer stator 210 and the inner stator 220 can be accurately adjusted and the interval therebetween can be constantly maintained.

In addition, the first step portion 722 of the middle support member 720 of the frame unit 700 supportedly contacts to be combined with the other step portion 212 of the outer stator 210 of the reciprocating motor, so that the assembly firmness can be increased.

Moreover, since the front frame 710 of the frame unit 700 supports both the outer stator 210 and the inner stator 220 of the reciprocating motor 200 and the middle support member 720 supports only the outer stator 210, a leakage of flux formed at the outer stator 210 and the inner stator 220 can be reduced.

Figure 10:
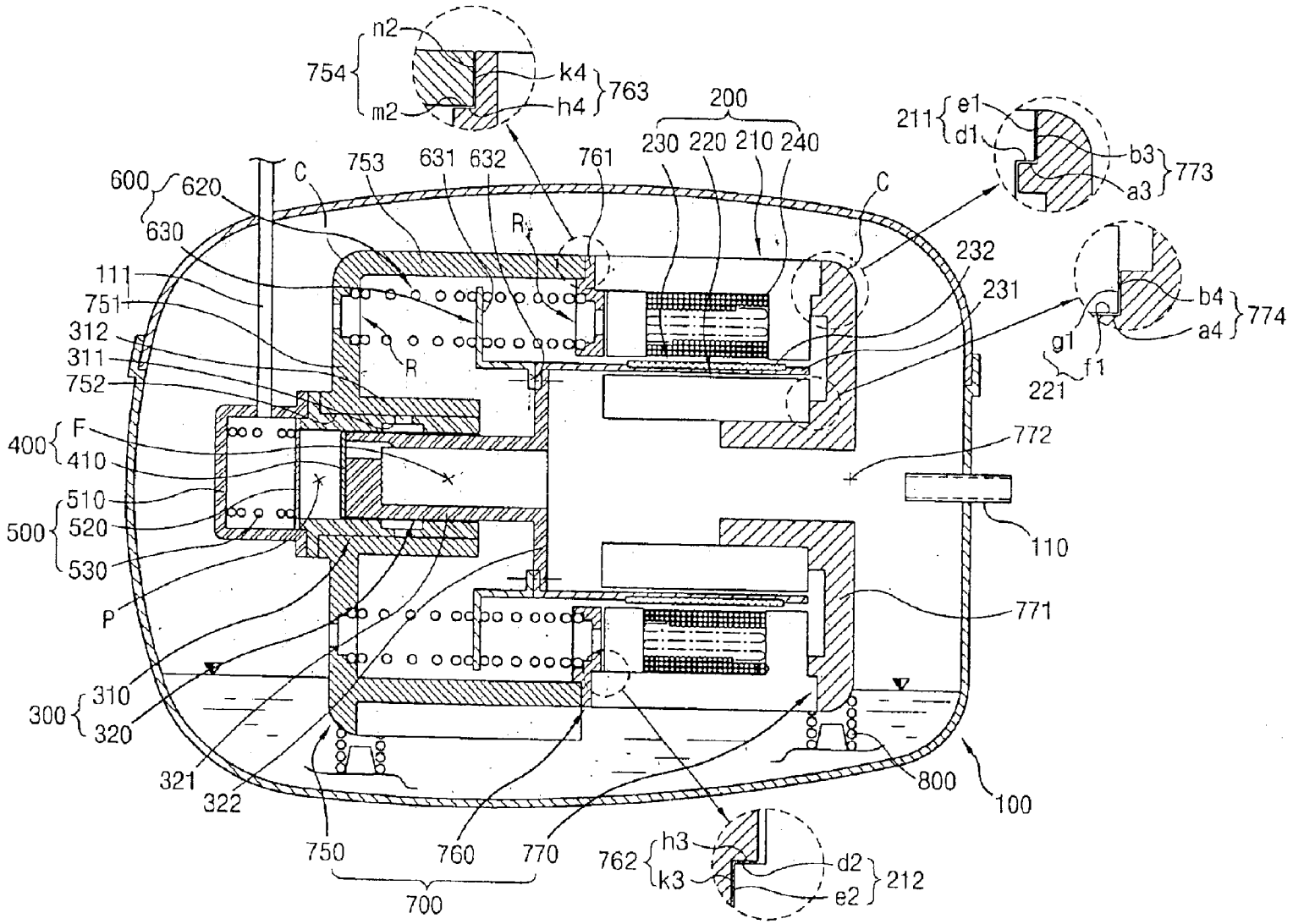
FIG. 10 is a sectional view showing a reciprocating compressor in accordance with a second embodiment of the present invention.

FIG. 10 is a sectional view showing a reciprocating compressor in accordance with a second embodiment of the present invention, in which a compression unit 300 and a reciprocating motor 200 are positioned with a predetermined interval therebetween.

The reciprocal compressor in accordance with the second embodiment of the present invention includes a container 100 provided with a gas suction pipe 110 through which a gas is sucked; a frame unit 700 installed inside the container 100, a reciprocating motor 200 mounted at the frame unit 700, for generating a linear and reciprocal driving force; a compression unit 300 mounted at the frame unit 700 at a predetermined interval from the reciprocating motor 200, for receiving the driving force of the reciprocating motor 200 and compressing a gas; a resonance spring unit 600 for elastically supporting the linear and reciprocal driving force of the reciprocating motor 200; a suction unit 400 positioned at one side of the compression unit 300, for rendering the gas sucked into the container 100 through the gas suction pipe 110 due to the pressure difference by he compression unit 300 to be sucked into the compression unit 300; a discharge unit 500 positioned at the other side of the compression unit 300, for discharging the gas compressed in the compression unit 300 to the outside of the container 100; and a support spring 800 elastically supporting the frame unit 700 at the container 100.

The frame unit 700 includes a front frame 750, a middle support member 760 and a rear frame 770. The rear frame 770 includes a body part 771 having a circle form and a predetermined thickness, a through hole 772 formed at the central portion of the body part 771, a first step portion 773 formed at the marginal portion of the body part 771 and a second step portion 774 formed at the middle of the body part 771.

The first step portion 773 and the second step portion 774 has circumferential faces a3 and a4 with a predetermined width and vertical faces b3 and b4 (in the drawing) formed vertical to the circumferential faces a3 and a4.

The circumferential face a3 of the first step portion 773 and the circumferential face a4 of the second step portion 774 make a concentric circle to each other.

The through hole 772 of the rear frame 770 is positioned adjacent to the gas suction pipe 110.

The reciprocating motor 200 includes the outer stator 210 and the inner stator 220 and the armature 230.

The reciprocating motor 200 includes an outer stator 210, an inner stator 220 and an armature 230.

The outer stator 210 is provided to be cylindrical form in which a winding coil 240 is combined, and step portions 211 and 212 are formed at both sides thereof.

The step portion 211 of the outer stator 210 is insertedly combined into the first step portion 773 of the rear frame 770.

At this time, a circumferential face d1 and a vertical face e1 (in the drawing) forming the step portion 211 of the outer stator and the circumferential face a3 and the vertical face b3 forming the first step portion 713 of the front frame supportedly contact each other.

The inner stator 220 has a cylindrical form with a predetermined thickness, of which a step portion 221 forming an inner corner is insertedly combined into the second step portion 774 of the rear frame 770.

At this time, the inner stator 220 is positioned with a predetermined interval at the inner side of the outer stator 210, and a circumferential face f1 and a vertical face g1 (in the drawing) forming the step portion 221 of the inner stator and the circumferential face a4 and the vertical face b4 forming the second step portion 774 of the rear frame 770 supportedly contact each other.

The armature 230 includes a magnet holder 231 having a cylindrical form and a permanent magnet 232 coupled to the outer circumferential surface of the magnet holder 231. The armature 230 is inserted between the outer stator 210 and the inner stator 220.

The middle support member 760 of the frame unit 700 includes a first step portion 762 formed at one side of the annular body 761 having a predetermined thickness and width and a second step portion 763 formed at the other side thereof.

A circumferential face h3 forming the first step portion 762 and a circumferential face h4 forming the second step portion 763 make the concentric circle, and the outer circumferential face of the annular body 761 and the circumferential face h3 forming the first step portion 762 make the concentric circle. The inner diameter of the annular body 761 is larger than the inner diameter of the outer stator 210 of the reciprocating motor 200.

The middle support member 760 is insertedly coupled to the step portion 212 of the outer stator of the reciprocating motor 200. At this time, the circumferential face h3 and the vertical face k3 (in the drawing) forming the first step portion 762 of the middle support member 760 and a circumferential face d2 and a vertical face e2 forming the step portion 212 of the outer stator 210 supportedly contact each other.

The front frame 750, which constructs the frame unit 700, includes a predetermined form of body part 751, a cylinder insertion hole 752 formed at the central portion of the body part 751, a cylindrical interval maintaining part 753 having a predetermined thickness and width and a step portion 754 formed at the end of the interval maintaining part 753.

The step portion 754 is formed with a circumferential face m2 having a predetermined with and a vertical face n2 (in the drawing) formed vertical to the circumferential face m2. The step portion 754 is formed by the corner of the interval maintaining part 753.

The step portion 754 of the front frame 750 is insertedly combined with the second step portion 763 of the middle support member 760.

At this time, the circumferential face m2 and the vertical face n2 forming the step portion 754 of the front frame 750 supportedly contact a circumferential face h4 and a horizontal face k4 forming the second step portion 763 of the middle support member 760, respectively.

The compression unit 300 includes a cylinder 310 and a piston 320.

The cylinder 310 is inserted into the cylinder insertion hole 752 of the front frame 750.

At this time, the inner diameter of the cylinder 310 and the circumferential faces a3 and a4 of the first and the second step portions 773 and 774 make the concentric circle, and the inner diameter of the cylinder 310 and circumferential faces h3 and h4 of first and second step portions 762 and 763 of the middle support member 760 make the concentric circle.

The piston 320 includes a flange 322 extended and bent to have a predetermined area at one side of the body part 321 having a annular bar form with a predetermined length in which a gas flowing passage (F) is formed in the longitudinal direction.

The body part 321 of the piston 320 is inserted into the cylinder 310 and the flange 322 is coupled to the armature 230. At this time, the gas flowing passage (F) of the cylinder 310 and the through hole 772 of the rear frame 770 communicate each other.

An annular groove 311 having a predetermined width and depth is formed on the inner wall of the cylinder 310 of the compression unit 300. The distance between the groove 311 and the front end of the head of the cylinder 310 is longer than the distance between the groove 311 and the rear end of the cylinder 310.

The groove 311 of the cylinder is preferably formed to be positioned roughly at the middle portion of the overall length of the piston 320 when the piston 320 comes to the bottom dead point.

At least one lubricant through hole 312 is provided within the groove 311 of the cylinder, having the smaller inner diameter than the width of the groove 311.

It is preferred that the lubricant through hole 312 is formed both at the upper and the lower portions, so as to be positioned in the vertical line on the basis of the lubricant face.

The resonance spring unit 600 includes a plurality of coil springs 620 and a spring support member 630 supporting the plurality of coil springs 620 along with the frame unit 700.

The spring support member 630 is formed with a predetermined area, including a support 631 supporting the coil spring 630 and a combining part 632 formed bent extended from the support 631.

The combining part 632 of the spring support member 630 is combined with the flange 322 of the piston 320 or the magnet holder 231, and the support 632 is positioned between the front frame 750 and the middle support member 760.

The plurality of coil springs 620 are combined between the spring support member 630 and the front frame 750, and the plurality of springs 620 are combined between the spring support member 630 and the middle support member 760.

It is preferred that the coil springs 620 combined between the spring support member 630 and the front frame 750 and the coil springs 620 combined between the spring support member 630 and the middle support member 760 are the same in number.

A resonance spring support (R) is provided at the front frame 750, the spring support member 630 and the middle support member 760 where the coil springs 620 are positioned, to which one side of the coil springs 620 is insertedly fixed.

Figure 11:
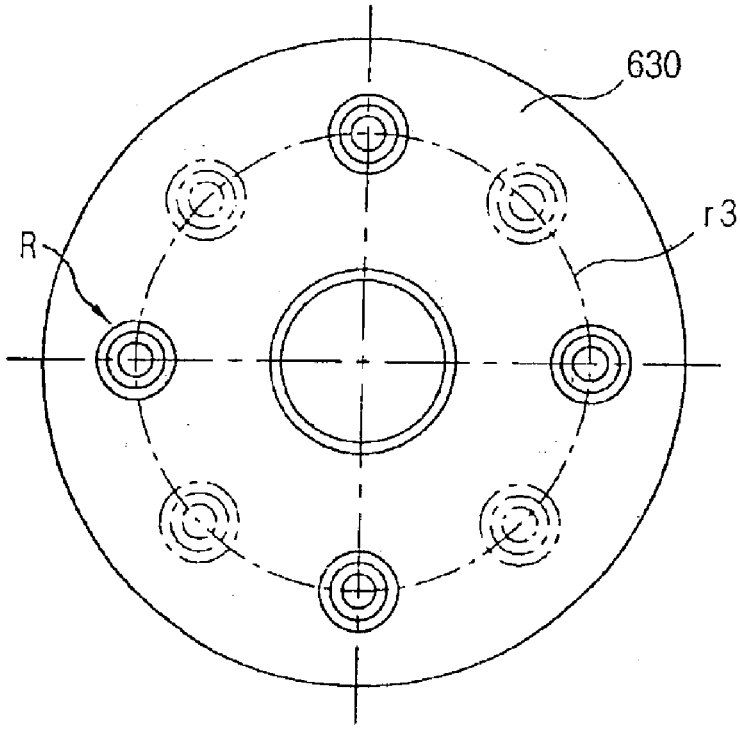
FIG. 11 is a schematic view showing a position of a resonance spring support of the reciprocating compressor in accordance with the second embodiment of the present invention.

FIG. 11 is a schematic view showing a position of a resonance spring support of the reciprocating compressor in accordance with the second embodiment of the present invention.

As shown in FIG. 11, the resonance spring supports (R) are formed equivalent to the number of the coil springs. And, the resonance spring supports (R) formed at the front frame 750, the middle support member 760 and the spring support member 630 are stepped corresponding to the outer diameter of the coil spring 620.

The resonance spring support (R) are formed at equal intervals and arranged symmetrical to the central axis of the middle support member 760.

That is, the plurality of coil springs 620 positioned between the front frame 750 and the spring support member 630 and the plurality of coil springs 620 positioned between the middle support member 760 and the spring support 630 are arranged in parallel so as not to be positioned in the same central line, so that the eccentric force due to a torsion generated by the tensile contraction of the coil spring is solved.

Figure 12:
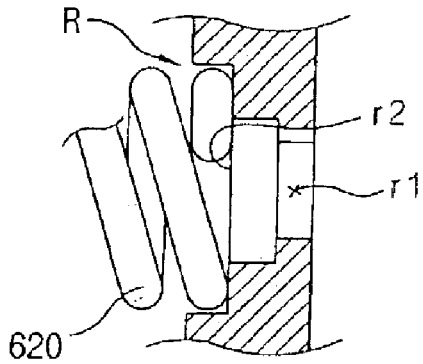
FIG. 12 is a partial sectional view showing a windage loss reducing through hole of the reciprocating compressor in accordance with the second embodiment of the present invention.

FIG. 12 is a partial sectional view showing a windage loss reducing through hole of the reciprocating compressor in accordance with the second embodiment of the present invention.

As shown in FIG. 12, a through hole r1 for reducing a windage loss is formed at the middle of the resonance spring support (R), and the step faces r2 of each resonance spring support (R) of the middle support member 760 and the front frame 750 are all formed positioned on the same plane.

A circle r3 connecting the central line of the plurality of resonance spring supports (R) make the concentric circle with the circumferential faces h3 and h4 forming the first and the second step portions 762 and 763 of the middle support member 760.

Preferably, the middle support member 760, the front frame 750 and the spring support member 630, where the resonance spring support (R) is formed, are made of a material having the same hardness as that of the coil spring 620.

Preferably, the resonance spring support (R) is also made of a material having the same hardness as that of the coil spring 620.

Figure 13:
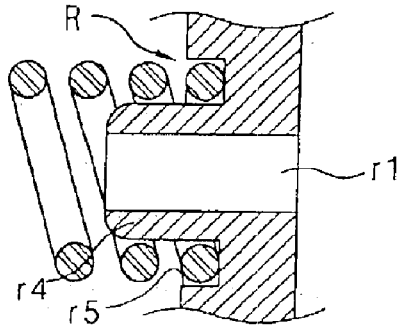
FIG. 13 is a partial sectional view showing a support protrusion and an insertion recess formed at the spring support of the reciprocating compressor in accordance with the second embodiment of the present invention.

FIG. 13 is a partial sectional view showing a support protrusion and an insertion recess formed at the spring support of the reciprocating compressor in accordance with the second embodiment of the present invention.

As shown in FIG. 13, the resonance spring support (R) includes a support protrusion r4 protruded toward inner diameter of the coil spring 620, and a circular insertion recess r5 formed around the support protrusion.

The support protrusion r4 may be fabricated as a separate component and a through hole is formed at the middle support member 760 and the front frame 750, so that the support protrusion may be forcibly inserted into the through hole and fixed therethrough. The through hole r1 is formed at the central portion of the support protrusion r4.

Figure 14:
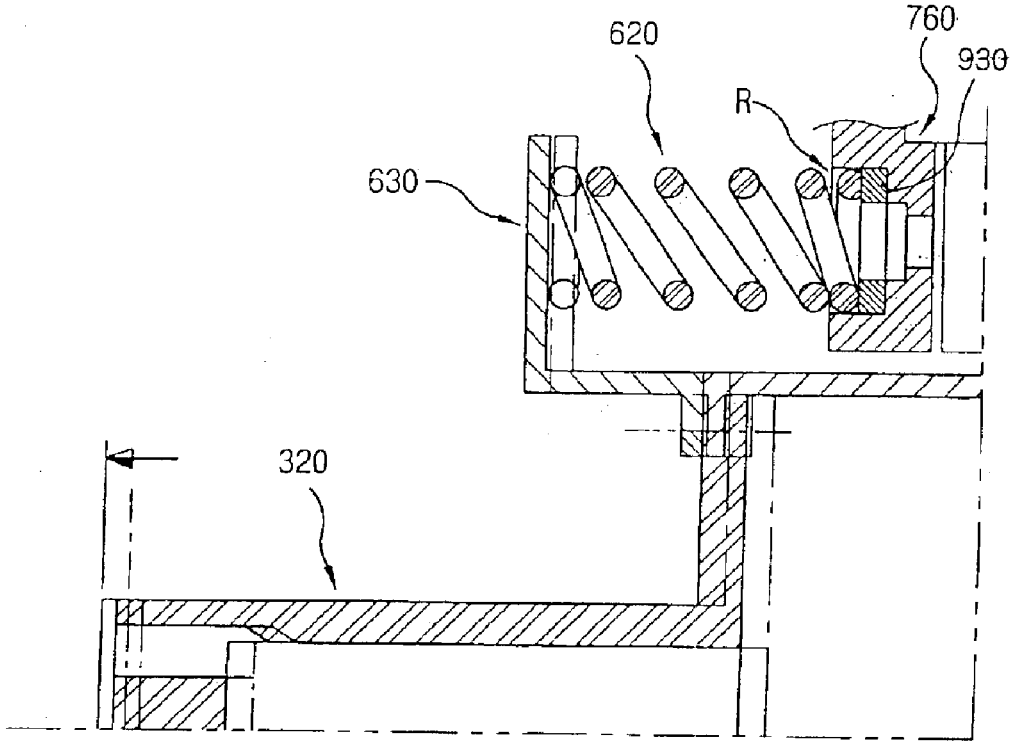
FIG. 14 is a partial sectional view showing a construction of an initial position control member of the reciprocating compressor in accordance with the second embodiment of the present invention.

FIG. 14 is a partial sectional view showing a construction of an initial position control member of the reciprocating compressor in accordance with the second embodiment of the present invention.

As shown in FIG. 14, an initial position control member 930 for controlling the initial position of the piston 320 of the compression unit 300 is provided at the resonance spring support (R). The initial position control member 930 is formed as an annular plate having a predetermined thickness.

When an initial position of the piston 320 which constructs the compression unit 300 is set, the initial position of the piston 320 is controlled by inserting the initial position control member 930 having a predetermined thickness in the coil spring 620 and the spring support (R) fixedly supporting the coil spring 620.

The suction unit 400 includes a gas flowing passage (F) formed at the through hole 772 of the rear frame 770, at the inner hole of the inner stator 220 of the reciprocating motor and inside the body part 321 of the piston 320 and a suction valve 410 coupled to the front end of the piston 320, for opening and closing the gas flowing passage (F) according to the pressure difference.

The discharge unit 500 includes a discharge cover 510 combined to cover the cylinder 310, that is, the compression space (P), a discharge valve 520 positioned inside the discharge cover 510, for opening and closing the compression space (P) of the cylinder 310, and a valve spring 530 for elastically supporting the discharge valve 520.

The front frame 750, the middle support member 760 and the rear frame 770 which support the both sides of the reciprocating motor 200 is engaged by a plurality of engaging bolts and nuts each having a predetermined length.

Figure 15:
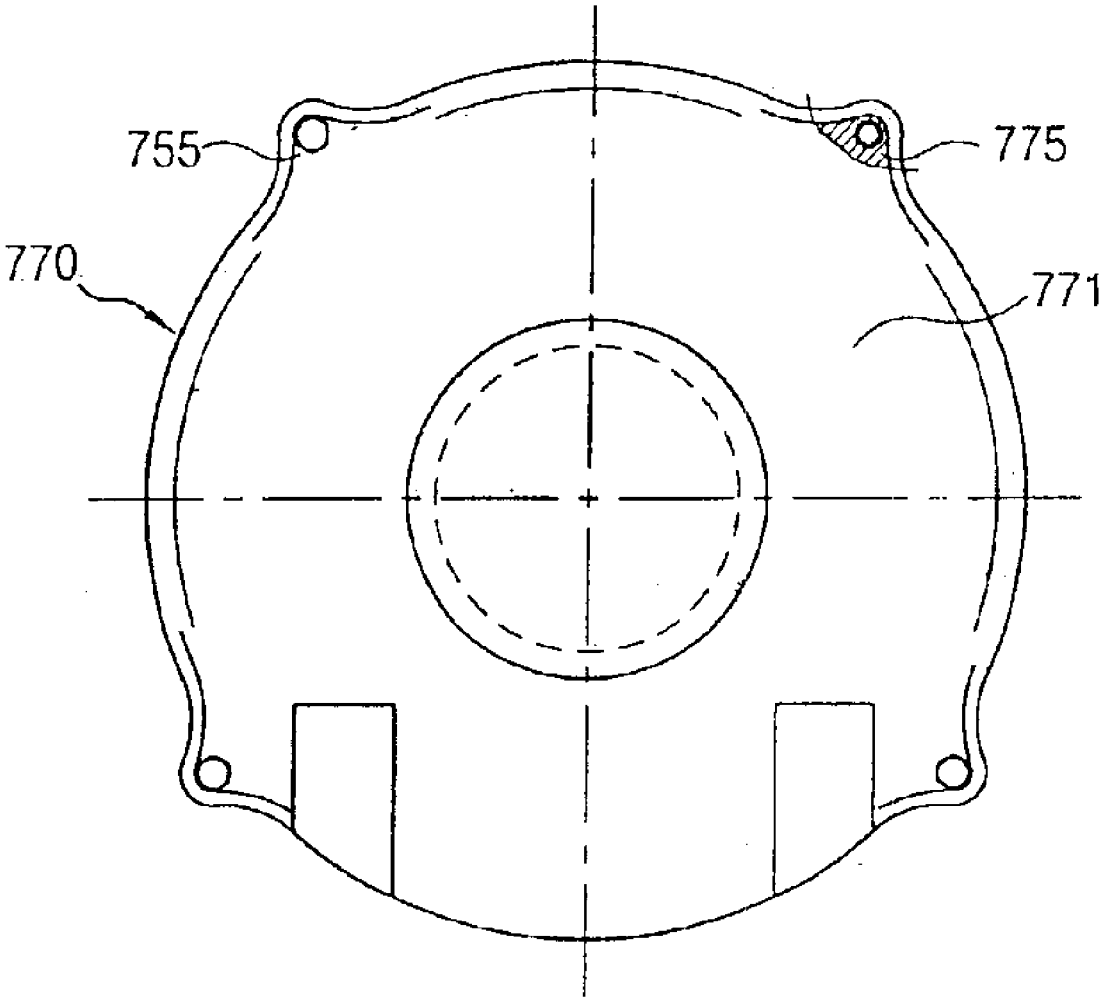
FIG. 15 is a schematic view showing a bolt engaging part of the reciprocating compressor in accordance with the second embodiment of the present invention.

FIG. 15 is a schematic view showing a bolt engaging part of the reciprocating compressor in accordance with the second embodiment of the present invention.

As shown in FIG. 15, when explained in view of the rear frame 770, the bolt engaging portion 775 is extendedly protruded in a semi-circle form at the marginal portion of the body part 717 of the rear frame, in which a screw hole is formed.

The plurality of bolt engaging portions 775 are disposed at the upper and the lower sides on the basis of a horizontal line when the rear frame 770 is vertically positioned, and the bolt engaging portions 775 are positioned at the left and the right sides on the basis of the central vertical line of the rear frame 770, that is, specifically, of the body part 771 of the rear frame 700.

The front frame 750 and the middle support member 760 may be engaged by an engaging unit, and the middle support member 760 and the rear frame 770 may be engaged by a separate engaging unit.

A fillet portion (C) is formed at the corner portions of the front frame 750, the rear frame 770 and the middle support member 760 which construct the frame unit 700.

The fillet portion (C) includes a relatively large portion and a relatively small portion.

The fillet (C) may be modified to a flat form chamfer.

Since the front frame 750 constructing the frame unit 700 and the bolt engaging portion 715 engaging the middle support member 760 and the rear frame 770 are positioned between the vertical line and the horizontal line rather than being positioned on the central vertical line and the horizontal line of the frame unit 700, and the fillet (C) is provided at the corner of the frame unit 700, the frame unit 700 is prevented from contacting the inner face of the container 100 and the distance to the inner face is minimized. Thus, its structure is compact.

The support spring 800 includes a plurality of coil springs. One side of the support spring 800 is fixedly supported at the bottom of the container 100 and the other side thereof is fixedly supported by the frame unit 700.

The structure in which the support spring 800 and the frame unit 700 are fixedly supported is the same as described with respect to the first embodiment.

As described in the first embodiment, a first connector 120 having two power supply terminals 121 to which an external power is supplied and at least one fixing terminal 122 is formed at the container 100.

A second connector 920 is provided having two power supply terminals 921 connected to the power supply terminal 121 of the first connector 120 and withdrawn from the reciprocating motor 200 to supply a power to the reciprocating motor 200 and a fixing terminal 922 insertedly combined with the fixing terminal 122 of the first connector.

The operation mechanism of the reciprocating compressor in accordance with the second embodiment is similar to that of the first embodiment.

In the reciprocating compressor of the second embodiment of the present invention, since the piston 320 is linearly and reciprocally moved in the cylinder 310 upon receipt of the linear and reciprocal driving force of the reciprocating motor 200, to compress the gas, the reciprocating compressor is stably driven.

In addition, since the stroke of the piston 320 can be controlled by controlling the linear movement distance of the reciprocating motor 200, the amount of the compressed gas to be discharged can be accurately controlled.

The step portion 211 of the outer stator 210 which constructs the reciprocating motor 200 supportedly contacts to be combined with the first step portion 773 of the rear frame 770 which constructs the frame unit 700, and the step portion 221 of the inner stator 220 of the reciprocating motor 200 supportedly contacts to be combined with the second step portion 774 of the front frame 770, so that the concentricity of the outer stator 210 and the inner stator 220 can be accurately adjusted and the interval therebetween can be constantly maintained.

In addition, the first step portion 762 of the middle support member 760 of the frame unit 700 supportedly contacts to be combined with the other step portion 212 of the outer stator 210 of the reciprocating motor, so that the assembly state is firm.

The components constructing the frame unit 700, the reciprocating motor 200 and the compression unit 300 are combined by being contacted and supported by the step portions forming the concentric circle, so that the assembly tolerance is minimized and the assembly working is easy.

Moreover, since the rear frame 770 of the frame unit 700 supports both the outer stator 210 and the inner stator 220 of the reciprocating motor 200 and the middle support member 760 supports only the outer stator 210, a leakage of flux formed at the outer stator 210 and the inner stator 220 can be reduced.

As so far described, the reciprocating compressor of the present invention has many advantages.

For example, first, since the stable driving is made in its operating, generation of a vibration and a noise can be minimized, heightening a reliability.

Secondly, since the gas discharge amount according to the stroke control can be accurately controlled, an unnecessary loss can be reduced.

Thirdly, the assembly tolerance of the components can be minimized, the assembly working is easy, and thus, the compression performance is heightened and assembly productivity can be improved.

It will be apparent to those skilled in the art that various modifications and variations can be made including plasma polymerization on the surface of the material of the present invention without departing from the spirit or scope of the invention. Thus, it is intended that the present invention cover modifications and variations of this invention provided they come within the scope of the appended claims and their equivalents.

What is claimed is:

1. A reciprocating compressor comprising:

a container communicating with a gas suction pipe for sucking a gas;

a reciprocating motor installed in the container and having an outer stator and an inner stator, each stator having an inner and an outer diameter and being provided with at least one step portion at both sides thereof, and an armature for linearly moving therebetween;

a compression unit having a cylinder and a piston inserted in the cylinder to receive a linear and reciprocal driving force of the reciprocating motor and compress a gas while making a linear and reciprocal movement;

a suction unit sucking a gas sucked into the container through the gas suction pipe due to a pressure difference in the compression unit, into the compression unit;

a discharge unit discharging the gas compressed in the compression unit to outside the container;

a resonance spring unit elastically supporting the piston and the armature; and a frame unit supporting the compression unit and the reciprocating motor and having a front frame which supports the reciprocating motor at the front side and a rear frame which supports the reciprocating motor at the rear side, one of the front and the rear frame having at least two step portions for supporting both outer stator and inner stator of the reciprocating motor, the front frame and the rear frame having at least one step portion for receiving one of the steps of the outer or inner stator, the circumferential face of which forms a concentric circle with the inner diameter of the cylinder.

2. The compressor of claim 1, wherein a middle support member is inserted between one of the front frame and the reciprocating motor and the rear frame and the reciprocating motor, to support the reciprocating motor together.

3. The compressor of claim 2, wherein the resonance spring unit comprises a coil spring and middle support member that includes at least one resonance spring support formed with a step portion corresponding to the outer diameter of the coil spring, so as to support the coil spring of the resonance spring unit.

4. The compressor of claim 3, wherein resonance spring supports are formed at equal intervals.

5. The compressor of claim 3, wherein resonance spring supports are arranged symmetrical to the central axis of the middle support member.

6. The compressor of claim 3, wherein the middle support member or the spring support is made of a material having the same hardness as that of the coil spring of the resonance spring unit.

7. The compressor of claim 3, wherein each step face of the step portions is formed on the same plane.

8. The compressor of claim 3, wherein the resonance spring support includes a support protrusion protruded toward an inner diameter of the coil spring.

9. The compressor of claim 8, wherein a circular insertion recess is formed at a contact line where an outer circumference of the support protrusion and a face of the middle support member are met.

10. The compressor of claim 3, wherein a through hole is formed at the at least one resonance spring support.

11. The compressor of claim 10, wherein the support protrusion is fixedly inserted into the through hole.

12. The compressor of claim 11, wherein a through hole is formed at an inner side of the support protrusion.

13. The compressor of claim 3, wherein an initial position control member for controlling an initial position of the piston of the compression unit is provided at the resonance spring support.

14. The compressor of claim 13, wherein the initial position control member is formed in an annular plate with a predetermined thickness.

15. The compressor of claim 1, wherein a fillet having a curved surface or a flat surface is formed at the corners of the front frame and the rear frame of the frame unit.

16. The compressor of claim 15, wherein the fillet includes a portion with a relatively wide width and a portion with a relatively narrow width.

17. The compressor of claim 1, wherein a support spring for supporting components positioned inside the container is provided at the bottom of the container, of which one side is supported at the bottom of the container and the other is supported by the frame unit.

18. The compressor of claim 17, wherein a combining protrusion for supporting the support spring is provided at the frame unit, the combining protrusion being integrally formed with the frame unit.

19. The compressor of claim 18, wherein an insertion recess is formed at a contact line where an outer circumference of the combining protrusion and the frame unit meet.

20. The compressor of claim 1, wherein a plurality of bolt engaging portions are formed at the marginal portions of the frame unit, the bolt engaging portions being arranged at the upper and the lower sides on the basis of a horizontal line when the frame is vertically positioned.

21. The compressor of claim 20, wherein the bolt engaging portions are arranged at the left and right sides on the basis of the central vertical line of the frame unit.

22. The compressor of claim 1, wherein an annular groove with a predetermined width and depth is formed at an inner wall of the cylinder of the compression unit, and the distance between the groove and the front end of the head of the cylinder is greater than the distance between the groove and the rear end of the cylinder.

23. The compressor of claim 22, wherein the groove of the cylinder is substantially positioned at the middle portion of the overall length of the piston when the piston is positioned at the bottom dead point.

24. The compressor of claim 22, wherein at least one lubricant through hole with a smaller inner diameter than the width of the groove is formed in the groove of the cylinder.

25. The compressor of claim 24, wherein the lubricant through holes are formed positioned at the upper and the lower sides on the vertical line on the basis of the lubricant face.

26. The compressor of claim 1, wherein the piston has a flange and a mass member is provided at the flange of the piston which makes a linear reciprocating movement upon receipt of the driving force from the reciprocating motor and to which the armature of the reciprocating motor is combined.

27. The compressor of claim 26, wherein the mass member has a disk form with a predetermined thickness.

28. The compressor of claim 1, wherein the piston which makes a linear reciprocating movement upon receipt of the driving force from the reciprocating motor and the armature of the reciprocating motor are engaged by sequentially arranging the flange of the piston, the plastic armature and a resonance spring base supporting the resonance spring unit.

29. The compressor of claim 1, wherein a first connector having two power supply terminals to which an external power is supplied and a single fixing terminal is provided at one side of the container, and a second connector is provided having two power supply terminals coming out from the reciprocating motor so as to be connected with the power supply terminal of the first connector and supply a power to the reciprocating motor and a second connector having a fixing terminal insertedly combined with the fixing terminal of the first connector.

30. The compressor of claim 1, wherein the at least one step portion has a smaller outer diameter than the outer circumference of the rear frame adjacent to the reciprocating motor is provided at the rear frame of the frame unit.

31. A reciprocating compressor comprising:

a container communicating with a gas suction pipe for sucking a gas;

a reciprocating motor installed in the container and having an outer stator and an inner stator, each stator having an inner and an outer diameter and being provided with at least one step portion at both sides thereof, and an armature for linearly moving therebetween;

a compressor unit having a cylinder and a piston inserted in the cylinder to receive a linear and reciprocal driving force of the reciprocating motor and compress a gas while making a linear and reciprocal movement;

a suction unit sucking a gas sucked into the container through the gas suction pipe due to a pressure difference in the compression unit, into the compression unit;

a discharge unit discharging the gas compressed in the compression unit to outside the container;

a resonance spring unit elastically supporting the piston and the armature; and a frame unit supporting the compression unit and the reciprocating motor and having a front frame which supports the reciprocating motor at the front side and a rear frame which supports the reciprocating motor at the rear side, one of the front and the rear frame having at least two step portions for supporting both outer stator and inner stator of the reciprocating motor, the front frame and the rear frame having at least one step portion the circumferential face of which forms a concentric circle with the inner diameter of the cylinder;

wherein a middle support member is inserted between one of the front frame and the reciprocating motor and the rear frame and the reciprocating motor, to support the reciprocating motor together; and wherein the middle support member has two sides and a step portion is formed at both sides of the middle support member, one of which supportedly contacts the at least one step portion of the reciprocating motor and the other of which supportedly contacts the at least one step portion of the frame.

32. The compressor of claim 31, wherein circumferential faces of the step portion formed at both sides of the middle support member make a concentric circle.

33. A reciprocating compressor comprising:

a container communicating with a gas suction pipe for sucking a gas;

a reciprocating motor installed in the container and having an outer stator and an inner stator, each stator having an inner and an outer diameter and being provided with at least one step portion at both sides thereof, and an armature for linearly moving there between;

a compression unit having a cylinder and a piston inserted in the cylinder to receive a linear and reciprocal driving force of the reciprocating motor and compress a gas while making a linear and reciprocal movement;

a suction unit sucking a gas sucked into the container through the gas suction pipe due to a pressure difference in the compression unit, into the compression unit;

a discharge unit discharging the gas compressed in the compression unit to outside the container;

a resonance spring unit elastically supporting the piston and the armature; and a frame unit supporting the compression unit and the reciprocating motor and having a front frame which supports the reciprocating motor at the front side and a rear frame which supports the reciprocating motor at the rear side, one of the front and the rear frame having at least two step portions for supporting both outer stator and inner stator of the reciprocating motor, the front frame and the rear frame having at least one step portion the circumferential face of which forms a concentric circle with the inner diameter of the cylinder;

wherein a middle support member is inserted between one of the front frame and the reciprocating motor and the rear frame and the reciprocating motor, to support the reciprocating motor together; and wherein the middle support member is formed in a circle and has at least one step circumferential face making a concentric circle with its outer circumferential surface, so that the outer circumferential surface supportedly contacts the at least one step portions of the motor and the at least one step portion of the frame.

34. A reciprocating compressor comprising:

a container communicating with a gas suction pipe for sucking a gas;

a reciprocating motor installed in the container and having an outer stator and an inner stator, each stator having an inner and an outer diameter and being provided with at least one step portion at both sides thereof, and an armature for linearly moving there between;

a compression unit having a cylinder and a piston inserted in the cylinder to receive a linear and reciprocal driving force of the reciprocating motor and compress a gas while making a linear and reciprocal movement;

a suction unit sucking a gas sucked into the container through the gas suction pipe due to a pressure difference in the compression unit, into the compression unit;

a discharge unit discharging the gas compressed in the compression unit to outside the container;

a resonance spring unit elastically supporting the piston and the armature; and a frame unit supporting the compression unit and the reciprocating motor and having a front frame which supports the reciprocating motor at the front side and a rear frame which supports the reciprocating motor at the rear side, one of the front and the rear frame having at least two step portions for supporting both outer stator and inner stator of the reciprocating motor, the front frame and the rear frame having at least one step portion the circumferential face of which forms a concentric circle with the inner diameter of the cylinder;

wherein a middle support member is inserted between one of the front frame and the reciprocating motor and the rear frame and the reciprocating motor, to support the reciprocating motor together; and wherein the middle support member has a center and a through hole having a predetermined diameter is formed at the center of the middle support member, and wherein the inner diameter of the through hole is greater than the inner diameter of the outer stator of the reciprocating motor.

35. A reciprocating compressor comprising:

a container communicating with a gas suction pipe for sucking a gas;

a reciprocating motor installed in the container and having an outer stator and an inner stator, each stator having an inner and outer diameter and being provided with at least one step portion at both sides thereof, and an armature for linearly moving therebetween;

a compressor unit having a cylinder and a piston inserted in the cylinder to receive a linear and reciprocal driving force of the reciprocating motor and compress a gas while making a linear and reciprocal movement;

a suction unit sucking a gas sucked into the container through the gas suction pipe due to a pressure difference in the compression unit, into the compression unit;

a discharge unit discharging the gas compressed in the compression unit to outside the container;

a resonance spring unit elastically supporting the piston and the armature; and a frame unit supporting the compression unit and the reciprocating motor and having a front frame which supports the reciprocating motor at the front side and a rear frame which supports the reciprocating motor at the rear side, one of the front and the rear frame having at least two step portions for supporting both outer stator and inner stator of the reciprocating motor, the front frame and the rear frame having at least one step portion the circumferential face of which forms a concentric circle with the inner diameter of the cylinder;

wherein a middle support member is inserted between one of the front frame and the reciprocating motor and the rear frame and the reciprocating motor, to support the reciprocating motor together; and wherein a circle connecting the central lines of the plurality of resonance spring supports makes a concentric circle with the circumferential face forming the step portions of the middle support member.

36. A reciprocating compressor comprising:

a container communicating with a gas suction pipe for sucking a gas;

a reciprocating motor installed in the container and having an outer stator and an inner stator, each stator having an inner and an outer diameter and being provided with at least one step portion at both sides thereof, and an armature for linearly moving therebetween;

a compression unit having a cylinder and a piston inserted in the cylinder to receive a linear and reciprocal driving force of the reciprocating motor and compress a gas while making a linear and reciprocal movement;

a suction unit sucking a gas sucked into the container through the gas suction pipe due to a pressure difference in the compression unit, into the compression unit;

a discharge unit discharging the gas compressed in the compression unit to outside the container;

a resonance spring unit elastically supporting the piston and the armature; and a frame unit supporting the compression unit and the reciprocating motor and having a front frame which supports the reciprocating motor at the front side and a rear frame which supports the reciprocating motor at the rear side, one of the front and the rear frame having at least two step portions for supporting both outer stator and inner stator of the reciprocating motor, the front frame and the rear frame having at least one step portion the circumferential face of which forms a concentric circle with the inner diameter of the cylinder; and wherein the frame unit further includes an inner support member for supporting the inner circumferential wall of the inner stator of the reciprocating motor.

37. The compressor of claim 36, wherein the circumferential face of the step portion of the middle support member and the outer diameter of the inner support member make a concentric circle.

38. The compressor of claim 36, wherein a stopper for supporting the step portion of the inner stator is provided at the end of the inner support member so that the inner stator may not be pushed in the movement direction of the piston.

39. The compressor of claim 36, wherein the inner support member is integrally combined with the inner stator by welding or bolting.

* * * * *